United States Patent [19]

Kakar et al.

[11] 4,296,165

[45] Oct. 20, 1981

[54] ANTISTATIC NATURAL AND SYNTHETIC TEXTILE MATERIALS WHICH HAVE BEEN TREATED WITH SALTS OF ORTHOPHOSPHORIC OR POLYPHOSPHORIC ACID

[75] Inventors: Sarwan K. Kakar, Flat Rock; Frank R. Kappler, Wyandotte; John J. Cramer, Grosse Ile, all of Mich.

[73] Assignee: The Diversey Corporation, Northbrook, Ill.

[21] Appl. No.: 53,824

[22] Filed: Jul. 2, 1979

Related U.S. Application Data

[63] Continuation of Ser. No. 899,130, Apr. 24, 1978, abandoned.

[51] Int. Cl.[3] ..... D06M 3/16; D06M 5/00; D06M 11/08

[52] U.S. Cl. ..... 428/264; 252/8.6; 252/8.8; 428/265; 428/267; 428/272; 428/289; 428/395

[58] Field of Search ..... 252/8.8, 8.6; 428/272, 428/288, 289, 265, 267, 264, 395

[56] References Cited

U.S. PATENT DOCUMENTS 2,742,379 4/1956 Schofield ..... 428/394

*Primary Examiner*—James C. Cannon

*Attorney, Agent, or Firm*—Merriam, Marshall & Bicknell

[57] ABSTRACT

Natural and synthetic textile materials and blends thereof are disclosed containing at least one water-soluble, neutral alkanolamine, ammonium or mixed alkanolamine and ammonium salt of a phosphoric acid wherein said acid is selected from the group consisting of orthophosphoric acid and polyphosphoric acid. Polyester-cotton fabrics are rendered antistatic by treatment with these ionic bonded salts in the proportion of about 0.5 to about 10 percent by weight based on the weight of the textile fabric.

11 Claims, No Drawings

ANTISTATIC NATURAL AND SYNTHETIC TEXTILE MATERIALS WHICH HAVE BEEN TREATED WITH SALTS OF ORTHOPHOSPHORIC OR POLYPHOSPHORIC ACID

This is a continuation, of application Ser. No. 899,130, filed Apr. 24, 1978, and now abandoned.

BACKGROUND OF THE INVENTION

1. Field of the Invention

The invention relates to antistatic textile materials and processes therefore wherein textile fabrics can be rendered effectively antistatic easily and economically.

2. Description of the Prior Art

Certain of the applicants' water-soluble anti-static agents are disclosed in copending commonly-assigned application, Ser. No. 656,116, filed Feb. 9, 1976 and now U.S. Pat. No. 4,208,263, for use in the preparation of non-durable, flame-repellent synthetic fabrics but the applicants' use of these materials is never disclosed or suggested.

Diethanolamine reaction products of orthophosphates and higher phosphates are disclosed in U.S. Pat. No. 3,428,481 as antistatic agents for textile fibers. The orthophosphate and higher phosphate esters are disclosed as reaction products of straight-chained, saturated primary aliphatic alcohols having 8 to 18 carbon atoms and about 1.1 to about 1.6 alkyl group per phosphorus atom.

Ammonium phosphates as antistatic agents for incorporation into polymeric resins are disclosed in U.S. Pat. No. 3,364,192. The antistatic agents are tertiary amine salts of phosphoric and diphenyl phosphoric esters. Polyethylene is disclosed as a suitable polymeric resin into which the antistatic agents can be incorporated.

The use of an alkanolamine ionically-bonded salt of an inorganic acid such as phosphoric acid is known for use in fireproofing textile materials as taught in U.S. Pat. No. 2,032,605. Coatings on yarns and filaments of from 20 percent to 50 percent based upon the weight of the yarn of the alkanolamine salt of phosphoric acid provides fireproofing and lubricity of the yarn.

In no one of the references above are the inventive ionically-bonded antistatic agents disclosed for use or suggested for use as antistatic agents for textile materials.

SUMMARY OF THE INVENTION

Natural and synthetic antistatic textile materials and processes therefore are disclosed wherein as antistatic agents there are utilized at least one of the neutral, water-soluble alkanolamine, ammonium, or mixed alkanolamine and ammonium salt of an orthophosphoric acid or a polyphosphoric acid. The ionically-bonded antistatic agents of the invention can be employed to prevent the accumulation of a high level of static charge on natural and synthetic fabrics and fabrics produced using blends of natural and synthetic fibers such as those produced using a blend of polyethylene terephthalate and cotton fibers. The application of the antistatic agents of the invention to fabrics is economical in that only about 0.5 to about 10 percent, preferably about 1 to about 6 percent, and most preferably about 1 to about 4 percent, all by weight based upon the weight of the fabric is utilized. The antistatic effect is not permanent to washing of the fabric. The antistatic agents of the invention being water-soluble, reapplication to the fabric must be performed subsequent to each washing of the fabric.

Detailed Description of the Preferred Embodiments

The antistatic agents of the invention are neutral, water-soluble, ionically-bonded alkanolamine, ammonium, or mixed alkanolamine and ammonium salts of orthophosphoric acid or polyphosphoric acid or mixtures thereof.

The antistatic agents of the invention can be prepared by reacting orthophosphoric acid or polyphosphoric acid or mixtures thereof in an aqueous solution with primary, secondary or tertiary alkanolamines or mixtures thereof. The reaction can be accelerated by heating to a temperature of about 100° F. to 180° F. and holding the reaction mixture at this temperature while under constant agitation for a period of about 10 minutes to about 60 minutes. Generally, the ionized antistatic agents of the invention are not isolated as reaction products but the reaction mixture is utilized in the treatment of natural and synthetic fabrics to impart antistatic properties thereto.

The aqueous solutions of the antistatic agents of the invention are utilized at a pH which is essentially neutral, that is, a pH of about 6 to about 8. The pH can be achieved by insuring that all the acid groups of the orthophosphoric acid or polyphosphoric acid are reacted by the use of a stoichiometric amount of the primary, secondary or tertiary amine reactant. Alternatively, the pH can be adjusted with a base, for instance, ammonium hydroxide. It is important to control the pH of the treating solution particularly where blends of polyethylene terephthalate fibers and cotton fibers are utilized in the preparation of the fabric to be rendered antistatic. This is to avoid discoloration of the fabric which may occur upon subsequent heating as in pressing the fabric using a heated iron.

The antistatic agents of the invention can be applied to the natural or synthetic textile material, such as a fabric to be rendered antistatic, by conventional methods such as spraying, dipping, wiping, or soaking the fabric in an aqueous solution of the antistatic agent. Said antistatic agents can be used either alone or in combination with conventional ingredients such as dyes, fabric softeners, optical brighteners, starches, and the like. Ordinarily, an amount of antistatic agent of about 1 to about 10 percent by weight based upon the weight of the fabric, said weight being based upon a dry basis add-on, is sufficient to impart a desirable antistatic effect.

The application of the above amount of antistatic agent has been found to have no adverse effect on the hand of the treated fabric but instead provides a certain lubricity to the fabric which is in most cases highly desirable. The proportion of antistatic agent added to the fabric to be treated can vary depending upon the nature of the fabric being treated. For instance, where an all-synthetic fabric is used such as a polyamide or a polyester fabric, a large amount of antistatic agent will be necessary to provide a suitable degree of antistatic effect. Where a mixture of any synthetic fiber and a natural fiber, for instance, polyester and cotton, is treated, a lesser amount of antistatic agent is necessary in order to achieve a suitable antistatic effect. Therefore, the preferred proportion of antistatic agent can be about 0.5 percent to about 10 percent by weight based upon the weight of the fabric where polyester-cotton fabrics are treated and preferably about 1 percent to about 6 percent where fabrics containing only synthetic fibers are treated with antistatic agent. Most preferably, about 1 percent to about 4 percent by weight of antistatic agent is utilized based upon the weight of the fabric to be treated.

The antistatic agents of this invention are particularly useful for the treatment of polyester-cotton blended fabrics where these fabrics contain about 55 to about 65 percent of polyester and the remainder of cotton. For treatment of these fabrics, an antistatic agent prepared by reacting 80 percent by weight of monoammonium phosphate with 20 percent by weight of monoethanolamine has been found to be particularly effective. Alternatively, an antistatic agent prepared by combining 80 percent by weight of monoammonium phosphate with 10 percent by weight monoethanolamine and 10 percent by weight of diethanolamine has been found particularly effective as an antistatic agent on blends of polyester and cotton, said blends containing 55 to 65 percent polyester and the remainder cotton.

The effectiveness of the antistatc agents of the invention in preventing the accumulation of a high static level on the fabric which has been treated therewith has been determined by measuring the surface resistivity of the treated fabrics and comparing the results obtained with the results obtained using comparable untreated fabrics. The greater the surface resistivity of the fabric, the greater the tendency of the fabric to act as an insulator and thus retain a static electricity charge. The resistivity is measured utilizing a Keithley apparatus which consists of an electrometer and a static detector. Resistivity determinations were made in accordance with ASTM D-257 test method using the above equipment. In accordance with this procedure, resistivity determinations were made and reported as resistivity, $\log_{10}$ on samples of fabrics treated with antistatic agents of the invention and conditioned at 10, 20, and 30 percent relative humidity at 25° C. prior to measuring surface resistivity. The samples were conditioned for 24 hours prior to evaluation.

The actual mechanism of charge conduction is generally believed to involve moisture that is tenaciously held by an antistatic agent applied to or impregnated within the yarn of a textile fabric. It is because the synthetic fibers generally do not absorb moisture that they tend to act as insulators and retain a static charge. Especially under low relative humidity conditions, such synthetic fibers as nylon and polyester exhibit a tendency to retain relatively high static charges. Generally, at high relative humidity, as would be expected, both nylon and polyester based fabrics do not exhibit a static electricity charge. Because the antistatic agents of the invention are characterized by excellent adhesion to synthetic fibers such as polyester and polyamide fibers, two fibers which offer generally little physical or chemical bonding possibilities, and because the antistatic agents of the invention are characterized by a multitude of hydroxyl groups in the structure of the condensate, it is believed that the application of the antistatic agents of the invention to fabrics composed of natural and synthetic or all-synthetic fibers provides a conduction pathway so that a substantial static charge fails to build up on the fabric.

The following examples will further illustrate the nature and method for preparing the antistatic agents of the invention and for treating fabrics based upon natural and synthetic fibers therewith. These examples, however, are not to be considered as limiting the invention. In the specification, claims and the examples which follow, all parts, percentages and proportions are by weight and all temperatures are in degrees centrigrade unless otherwise noted.

EXAMPLE 1

An antistatic agent of the invention was prepared as follows:

Into a double-jacketed stainless-steel mixing tank there was added 25 pounds of deionized water and 2.5 pounds of monoethanolamine. The temperature of the mixture was raised to 160° F. and then 20 pounds of monoammonium phosphate and 2.5 pounds of diethanolamine were poured into the mixture. The mixture was allowed to react for 30 minutes at a temperature of 160° F. while under constant agitation. The salt prepared remained soluble in water, the solids content beint 50% by weight. After cooling the mixture, the aqueous solution is ready for application to a natural or synthetic textile fabric.

EXAMPLE 2

A polyester-cotton fabric containing 65 percent polyester and 35 percent cotton was treated with various concentrations of the antistatic agent prepared in Example 1. At a wet pick-up percentage by weight of about 15 to 20 percent based upon the weight of the fabric, 3 inch by 5 inch samples of fabric were treated with various concentrations of the antistatic agent of the invention prepared in Example 1. The samples were subsequently dried at elevated temperature and conditioned 24 hours in a humidity chamber maintained at 80° F. with 20 percent relative humidity. Control samples of the same polyester-cotton fabric which were not treated with antistatic agent were similarly conditioned prior to testing for surface resistivity. Test results are shown in the Table below.

EXAMPLE 3

Utilizing the antistatic agent prepared in Example 1, a polyester-cotton fabric containing 50 percent polyester was treated with the antistatic agent of the invention in accordance with the procedure of Example 2. Surface resistivity results are shown in the Table.

EXAMPLE 4

Utilizing the antistatic agent of the invention, a polyamide fabric sold under the trademark "NOMEX" was treated to provide an antistatic fabric. When the fabric is treated in accordance with the procedure of Example 2, utilizing a treatment solution having a solids content of 3 and 4 percent respectively, a specific resistivity was obtained of $2.4\times10^{11}$ and $2.6\times10^{10}$ respectively. The polyamide based fabric prior to treatment showed a surface resistivity of $2.1\times10^{15}$.

TABLE

Surface Resistivity Polyester-Cotton Fabric Containing Antistatic Agent Of The Invention

| Example | % add-on by weight of antistatic-agent | Surface Resistivity ASTM D-257 @ 20% R.H. |
|---|---|---|
| 2 | — | $5.3\times10^{13}$ |
| 2 | 0.6 | $2.3\times10^{10}$ |
| 2 | 0.8 | $1.0\times10^{10}$ |
| 3 | — | $1.3\times10^{13}$ |
| 3 | 0.6 | $2.0\times10^{10}$ |

TABLE-continued

| Surface Resistivity Polyester-Cotton Fabric Containing Antistatic Agent Of The Invention | | |
|---|---|---|
| Example | % add-on by weight of antistatic-agent | Surface Resistivity ASTM D-257 @ 20% R.H. |
| 3 | 0.8 | $1.3 \times 10^{10}$ |

While this invention has been described with reference to certain specific embodiments it will be recognized by those skilled in the art that many variations are possible without departing from the scope and spirit of the invention.

The embodiments of the invention in which an exclusive property or privilege is claimed are defined as follows:

1. An antistatic synthetic textile material or blend of natural and synthetic textile materials impregnated with an antistatic amount of an antistatic agent consisting essentially of at least one of (A) a neutral, ionically-bonded ammonium salt of an orthophosphoric acid, (B) a neutral, ionically-bonded ammonium salt of a polyphosphoric acid, (C) a neutral, ionically-bonded mixed ammonium and alkanolamine salt of orthophosphoric acid in which the alkanolamine is a 2 or 3 carbon atom alkanolamine or a mixture thereof and (D) a neutral, ionically-bonded mixed ammonium and alkanolamine salt of polyphosphoric acid in which the alkanolamine is a 2 or 3 carbon atom alkanolamine or a mixture thereof.

2. An antistatic synthetic textile material or blend of natural and synthetic textile materials impregnated with an antistatic amount of an antistatic agent consisting essentially of a neutral, ionically-bonded ammonium salt of an orthophosphoric acid.

3. An antistatic synthetic textile material or blend of natural and synthetic textile materials impregnated with an antistatic amount of an antistatic agent consisting essentially of a neutral, ionically-bonded mixed ammonium and alkanolamine salt of orthophosphoric acid in which the alkanolamine is a 2 or 3 carbon atom alkanolamine or a mixture thereof.

4. An antistatic synthetic textile material or blend of natural and synthetic textile materials impregnated with an antistatic amount of an antistatic agent consisting essentially of a neutral, ionically-bonded ammonium salt of a polyphosphoric acid.

5. An antistatic synthetic textile material or blend of natural and synthetic textile materials impregnated with an antistatic amount of an antistatic agent consisting essentially of a neutral, ionically-bonded mixed ammonium and alkanolamine salt of a polyphosphoric acid in which the alkanolamine is a 2 or 3 carbon atom alkanolamine or a mixture thereof.

6. The antistatic textile of claim 3 or 5 wherein said antistatic agents are applied to said textile material to render said materials antistatic utilizing an amount of 0.5 to 10 percent by weight based on the weight of said textile material.

7. The antistatic textile of claim 6 wherein said textile material is a textile fabric derived from polyethylene terephthalate fibers in admixture with cotton fibers.

8. The antistatic textile of claim 6 wherein said textile material is a fabric prepared from polyamide fibers.

9. The antistatic textile of claim 2 or 4 wherein said antistatic agent is applied to said textile material to render said material antistatic utilizing an amount of 0.5 to 10 percent by weight based on the weight of said textile material.

10. The antistatic textile of claim 9 wherein said textile material is a textile fabric derived from polyethylene terephthalate fibers in admixture with cotton fibers.

11. The antistatic textile of claim 9 wherein said textile material is a fabric prepared from polyamide fibers.

* * * * *